United States Patent [19]

Kazama et al.

[11] 4,263,351

[45] Apr. 21, 1981

[54] COATING METHOD

[75] Inventors: Takahiko Kazama; Masahito Hongo; Yutaka Okuyama, all of Ohtsu, Japan

[73] Assignee: Toray Industries, Inc., Tokyo, Japan

[21] Appl. No.: 88,933

[22] Filed: Oct. 29, 1979

[51] Int. Cl.[3] ..... B05D 3/12; B05C 11/02

[52] U.S. Cl. ..... 427/355; 118/118; 118/119; 427/371

[58] Field of Search ..... 118/118, 119; 427/355, 427/358, 371

[56] References Cited

U.S. PATENT DOCUMENTS

| | | | |
|---|---|---|---|
| 3,084,663 | 4/1963 | Warner | 118/118 |
| 3,179,083 | 4/1965 | Warner | 118/119 X |
| 3,304,910 | 2/1967 | Warner | 118/118 X |
| 4,128,077 | 12/1978 | Meier | 118/118 X |

*Primary Examiner*—Michael R. Lusignan

*Attorney, Agent, or Firm*—Scully, Scott, Murphy & Presser

[57] ABSTRACT

A moving thermoplastic sheet having a thickness not smaller than 150μ is coated with a liquid coating agent in excess amount and then a metering bar rotating at about the same peripheral speed as the moving speed of the said sheet is contacted with the coated surface of the sheet whereby a coated thermoplastic sheet having a uniform coating layer is obtained.

8 Claims, 3 Drawing Figures

COATING METHOD

BACKGROUND OF THE INVENTION

This invention relates to a coating method and more particularly to the improvement of a method of applying a coating agent to one or both surfaces of a thermoplastic sheet (including film).

A stretched thermoplastic sheet is widely used in industrial and miscellaneous fields due to its superior mechanical and chemical properties as well as a high dimensional stability. In many cases the sheet is put to practical use after subjected to a surface treatment such as printing or coating (hereinafter non-surface-treated sheet is referred to as "base sheet"). One problem associated with the application of such surface treatment to obtain a final product is that the adhesion between the base sheet and final surface treating agent is not always satisfactory. Therefore, it is generally considered effective to apply a surface treatment to the base sheet before application of such a final surface treatment. In many cases, moreover, the base sheet is generally lacking in slipperiness, so in uses where a very high transparency is strongly required of the base sheet, the base sheet is preferably coated on its surface with a slipping agent with a view to improving the processability in subsequent treatments.

To coat a biaxially stretched thermoplastic film with a liquid coating agent for such purpose, the use of the following means has heretofore been generally known: metering bar, direct gravure, offset gravure, 2-roll pressure, 3-roll pressure, 2-roll reverse, 3-roll reverse, dip coating, 1-roll kiss coating, 2-roll kiss coating, trailing blade, nip coating, inverted knife, air knife, floating knife, blanket knife.

The coating methods using these means usually are applied to films 100μ or smaller in thickness. But it is the present situation that in case such methods are applied to sheets having a thickness not smaller than 150μ, disadvantages such as the occurence of defect of coating layer, lowering of working efficiency and irregularity in application are unavoidable. Among such coating methods, the one using a metering bar is regarded as being superior in point of uniformity of coating and working efficiency. But in case the conventional method wherein a metering bar is driven in reverse at low speed using a bar holder is applied to the coating for a thick sheet, there often occurs wire breaking and not only it is impossible to effect an industrial-scale operation stably for a long time, but also scratch trouble to the sheet and the occurrence of defects of coating layer caused by air bubbles are unavoidable. In an attempt to remedy such disadvantages associated with the metering bar system there has been proposed a method in which a liquid is fed to the metering bar. This method may be effective for reducing defects of coating layer, but it is difficult to prevent the occurrence of wire breaking during operation and scratch on the sheet.

It is an object of this invention to solve the problems associated with the prior art methods.

It is another object of this invention to provide a method capable of coating a thick sheet with a liquid coating agent uniformly over a long period of time without defects of coating layer, scratch on sheet or wire breaking.

It is a further object of this invention to provide a method of coating a sheet in the course of a sheet manufacturing process involving a stretching step.

Other objects of this invention will be apparent from the following description.

SUMMARY OF THE INVENTION

According to this invention, an excess amount of a liquid coating agent is applied onto a moving thermoplastic sheet having a thickness not smaller than 150μ and thereafter a metering bar rotating forward at a peripheral speed within ±10% of the moving speed of the said sheet is contacted with the coated surface of the sheet to smooth the coating layer.

The foregoing objects of this invention are attained effectively by the method of the invention. Particularly, the method of this invention is advantageously applied to a sheet moving in the course of a continuous sheet manufacturing process, preferably to a non-stretched or monoaxially stretched sheet before stretching in transverse direction or in longitudinal and transverse directions simultaneously. In the above case, the method of this invention is little affected by restrictions of the process conditions before and after the coating step (for example, the presence of a thickness distribution in the direction of the width, or the tension cannot be set below a certain level).

DETAILED DESCRIPTION OF THE INVENTION

Figure 1:
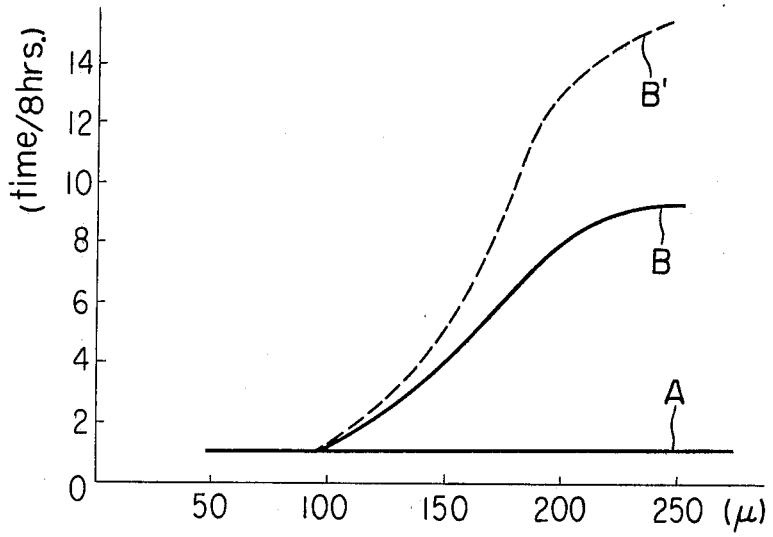

The method of this invention can be applied to any sheet having a thickness not smaller than 150μ consisting of a thermoplastic resin such as for example polypropylene, polyethylene, polyvinylchloride, polyester, or polyamide. Above all, preferably used is a polyethyleneterephthalate sheet which strictly requires transparency and freedom of surface defects. Regarding the thickness of these sheets, there is no upper limit if only they have a thickness of 150μ or more. Usually, however, a thickness not larger than 1000μ, especially a thickness ranging from 150 to 500μ, is preferred.

Further, the sheet to which is applied the method of this invention should have a number of protrusion per unit length of its surface of not more than 20, preferably not more than 10, per millimeter. The number of protrusion per unit length of the sheet surface as referred to herein means the number of 0.05μ or higher protrusion measured by the method of double beam measuring using an interference microscope.

An excess amount of a liquid coating agent is applied to the surface of such a sheet as the latter is moved and subsequently a metering bar rotating forward at a peripheral speed matching the moving speed of the sheet is contacted with the coated surface of the sheet.

The moving speed of the sheet is not higher than 90 m/min, preferably 10 to 80 m/min. At a speed exceeding 90 m/min, the non-uniformity of coating increases remarkably in the direction of the width.

Application of an excess amount of a liquid coating agent is effected by conventional means such as an applicator roll. The amount of a coating liquid to be applied before contact with a metering bar should be larger than the amount of application to be smoothed by the metering bar, but usually and preferably it is 2 to 20 times as large as the application amount to be smoothed by the metering bar.

As known well, the metering bar consists of a rod and a stainless steel wire which is wound round the rod with wire portions closely adhered to each other. The amount of a liquid coating agent to be applied is controlled by the diameter of the wire. The wire diameter is chosen according to the desired thickness of application, but usually it is not larger than 500μ, preferably 30 to 400μ. The rod diameter is preferably in the range of from 10 to 50 mm. Usually, the coating treatment is applied to the lower surface of a moving sheet and a surplus coating agent after metering with a metering bar is allowed to fall into a receiving pan disposed thereunder and is re-used as necessary.

Various methods are available for setting the peripheral speed of a metering bar within ±10% of the moving speed of a sheet, but practicially adopted is to feedback the moving speed of the sheet thereby setting the revolution of the metering bar, or to render the rotational torque of the metering bar as small as possible to permit a free rotation.

As a supporting method for a metering bar, the bar holder system has heretofore been generally adopted, but it is not preferred because troubles such as wire breaking and incorporation of air bubbles are liable to occur. In this invention, it is preferable that a bearing of a narrow width coated with a plastic material such as polytetrafluoroethylene be disposed in two or three places, two or three pieces in each place, in the direction of the width to support a metering bar.

As the coating agent, both an aqueous solution system and an organic solvent system are employable. Their viscosities should be in the range of from 0.2 cP to 1000 cP, preferably from 1 cP to 100 cP. At a viscosity lower than 0.2 cP the occurrence of air bubbles becomes remarkable, while at a viscosity higher than 1000 cP the coating irregularity in the longitudinal direction becomes conspicuous.

In case the method of this invention is applied to a coating treatment using a coating agent consisting of an aqueous solution system particularly with a resin concentration of 1 to 10 wt.%, there is obtained the effect that the occurrence of air bubbles can be prevented to a remarkable extent, in addition to other effects. In case a pre-applied liquid coating agent is smoothed with a metering bar according to a conventional method, there easily occurs a drawback such that air bubbles produced in the liquid between the wire in the metering part and the sheet pass wire gaps with the lapse of time and gets into the coated sheet. According to the method of this invention, though the reason is not clear, air bubbles in the liquid move along a metering bar toward both edges of a sheet and finally are concentrated only on the outermost ends of the coating layer on the sheet; as a result, the central portion can virtually be kept free from defects caused by air bubbles.

It is in the coating treatment as an intermediate step in a continuous sheet manufacturing process that the method of this invention exhibits a specially outstanding effect, in which manufacturing process a molten thermoplastic resin is extruded onto a casting drum to form a continuous sheet and the latter is then subjected to a stretching step to give a stretched sheet.

Particularly, it is preferable that the method of this invention be applied to a non-stretched or monoaxially stretched sheet before stretching in transverse direction or in longitudinal and transverse directions simultaneously. That is, in the case of coating a product which has been obtained by slitting a biaxially stretched sheet at a certain width, the coating conditions including tension can be suitably selected, and besides, the irregularity in thickness in the direction of the width is not so conspicuous, therefore it is not impossible to attain a uniform coating even under the prior art metering bar conditions. However, when coating is to be applied to a sheet non-stretched or after stretched monoaxially as an intermediate step in a sheet manufacturing process, the sheet thickness in coating becomes larger by an amount corresponding to the subsequent stretch magnification, and besides, the thickness in the direction of the width becomes fairly large due to neck-in, for which reason the prior art methods cannot be applied in a satisfactory manner. The method of this invention is specially effective when it is desired to obtain a thin and uniform coating surface by coating a non-stretched sheet and then stretching the sheet biaxially using a simultaneous biaxial stretcher, or in the case of coating a sheet after monoaxially stretching in longitudinal direction and then stretching it in transverse direction, or in the case of coating a non-stretched sheet, then stretching it in transverse direction and thereafter stretching it in longitudinal direction, or in the case of coating a sheet after stretching in longitudinal direction and then further stretching it in transverse direction and re-stretching it in longitudinal direction.

Coating may be applied to the entire width of the sheet, but when the coated sheet is thereafter subjected to stretching as mentioned above, the sheet goes through pre-heating, stretching and heat-setting processes while both edge portions thereof are held with clips, so the end portions of the sheet are trimmed and trashed. Usually, therefore, the sheet width is somewhat larger than coating of the resulting product; and it is preferable that the coating width be kept inside the clip holding portions at the sheet ends in stretching. The same treatment may be applied to one or both faces of the sheet as necessary.

As the method of making the coating width narrower than the entire width of the sheet, blowing air from the outside against the metering bar is a simple and effective method.

According to the method of this invention, a primer subbing treatment can be applied to a base sheet for photographic use such as a Roentgen film or a microfilm. Such photographic films usually are composed of a base sheet and the following layers formed thereon, a gelatin layer, silver salt layer, top coating layer. But in case the base sheet is a polyethyleneterephthalate sheet or the like, a thin, say 0.1μ, adhesive layer consisting of a water-soluble polyester or the like is generally provided with a view to improving the adhesion between the base sheet and the gelatin layer. The method of this invention is specially effective as a method of applying such a primer subbing in the sheet manufacturing process.

It is also preferable, in order to improve the uniformity of coating, that the sheet surface be subjected to a discharge treatment before application of a liquid coating agent.

DRAWINGS

FIG. 1 shows the relationship between the sheet thickness in coating and the breaking frequency of the wire of a metering bar, in which the sheet thickness (μ) is plotted along the axis of absicissa and the wire breaking frequency (time/8 hrs.) along the axis or ordinate. The sheet used was a polyethyleneterephthalate sheet, and the same coating agent as that used in Example 1 was used, the diameter of the metering bar wire was 75

μ and the moving speed of the sheet was 30 m/min. The peripheral speed of the metering bar as a control was set at 0.5 m/min in both forward (B) and reverse (B') directions with respect to the moving direction of the sheet. In the method of this invention, (A) was at a peripheral speed of 32 m/min, rotated in the same direction as the moving direction of the sheet.

Reference to FIG. 1 shows that in case the sheet thickness is around 100μ or smaller, the breaking of wire does not occur so frequently even according to the conventional method, but it becomes liable to occur at a sheet thickness exceeding 150μ.

Figure 2:
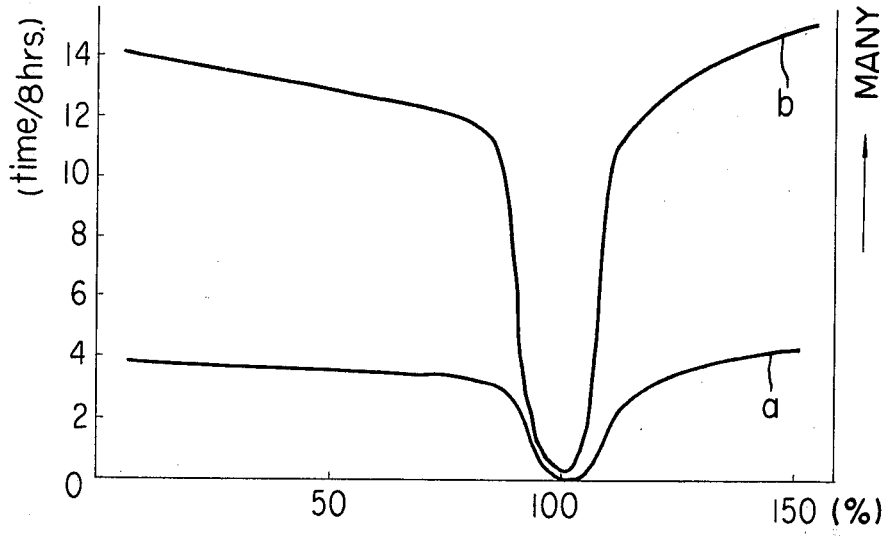

FIG. 2 shows the relationship between the ratio of the peripheral speed of the metering bar to the moving speed of the sheet during coating, and the breaking frequency of the metering bar wire as well as the number of scratches made on the base sheet, in which the value of $$\frac{\text{peripheral speed of metering bar}}{\text{moving speed of sheet}} \times 100(\%)$$

is plotted along the axis of abscissa, the wire breaking frequency (time/8 hrs.) is read along the lefthand axis of ordinate and the number of scratches made on the base sheet is read along the righthand axis of ordinate (in which the higher the position, the larger numbers of scratches made). In FIG. 2, moreover, the curves a and b represent the wire breaking frequency and the number of scratches made on the base sheet, respectively. The thickness and moving speed of the sheet were 150μ and 30 m/min, respectively, while the peripheral speed in the forward direction of the metering bar was varied. The other conditions were the same as in FIG. 1.

From FIG. 2 it is seen that when the peripheral speed of the metering bar is within ±10% of the moving speed of the sheet, the breaking of wire and the occurrence of scratch are decreased to a remarkable extent, and that a value within ±5% is preferable and further a value within ±2% is more preferable.

Figure 3:
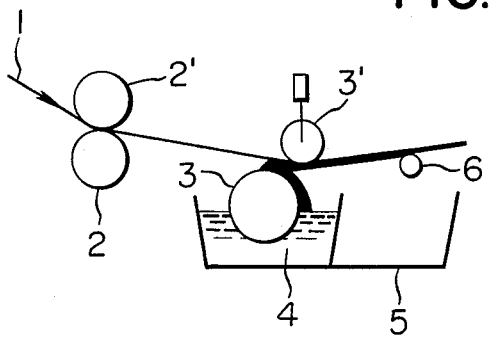

FIG. 3 is a schematic view showing an example of application of the method of this invention, in which a sheet 1 is fed to the coating zone by a driving roll 2 and a nip roll 2' and is coated with a liquid coating agent 4 by an applicator roll 3, then the coating amount is adjusted to a predetermined value by a metering bar 6. The reference numeral 3' is a clearance adjusting roll for controlling the application amount, and the numeral 5 is a vessel for receiving a surplus coating agent.

The following example of this invention is now given to further illustrate the invention.

EXAMPLE 1

Fully dried polyethyleneterephthalate chips were molten and fed continuously to a casting drum for cooling from an exturder held at 280°-290° C. to form a non-stretched sheet having a thickness of 1000μ. The sheet was then stretched 2.8 times in longitudinal direction at 80° C. and thereafter cooled at 60° C. to give a 360μ sheet. The sheet thus obtained was coated with a liquid coating agent except both edge portions 50 mm each in the direction of the width thereof. The coating conditions were as follows:

A. Coating agent
- (a) Aqueous solution of a water-soluble, low melting polyester
- (b) Resin concentration: 5 wt.%
- (c) Viscosity: 10 cP (20° C.)

B. Coating conditions
- (a) Metering bar: Bar dia. 25 mmϕ; Wire dia. 150 μϕ
- (b) Moving speed of sheet: 20 m/min
- (c) Peripheral speed of metering bar: 19.7 m/min
- (d) Contact angle of sheet: 6°
- (e) Tension exerted on sheet: 100 kg/total width The thickness of the coating layer after smoothed by the metering bar under the above conditions was 8μ on the average (in a state of an aqueous solution) with a variation of ±5%.

The so-coated sheet was then dried and pre-heated fully by a conventional stenter and it was stretched 3.0 times in transverse direction at 120° C., then heat-treated at 200° C. to give a film having a thickness of 125μ. The product thus obtained was free from defect of coating layer, free from irregularity of application and had a good appearance. This coating operation was continued for 8 hours, but there was neither breaking of the wire nor the flowing-out of air bubbles, and the product was free from surface defect caused by a stained wire with the lapse of time.

COMPARATIVE EXAMPLE 1

A test was made using the same coating agent and sheet manufacturing conditions as in Example 1 with the proviso that the metering bar was rotated at 0.5 m/min in the direction opposite to the moving direction of the sheet. During 5 to 10 minutes after initiation of the test, coating was as good as in Example 1, but in 30 minutes defects of coating layer caused by air bubbles became more and more conspicuous and many scratches were made, and in 1 hour the wire was broken.

COMPARATIVE EXAMPLE 2

In Comparative Example 1 the sheet tension was lowered from 100 kg to 50 kg to prevent the breaking of wire, but the strong stiffness in transverse direction of the sheet caused irregularity in contact between the sheet and the wire in the direction of the width, resulting in that the coating became irregular to a remarkable extent.

COMPARATIVE EXAMPLE 3

A test was made using the same coating agent and coating conditions as in Example 1 with the limitation that the peripheral speed of the metering bar was set at 1.25 m/min [50 r.p.m. in terms of the revolution of the bar (forward rotation)]. However, like Comparative Example 2, the wire was broken and scratches were made on the sheet surface.

We claim:

1. A coating method comprising coating a moving thermoplastic sheet having a thickness not smaller than 150μ with a liquid coating agent in excess amount and then contacting a freely rotating metering bar rotating at a peripheral speed within ±10% of the moving speed of said sheet with the coated surface of said sheet.

2. The coating method as defined in claim 1, in which the moving speed of said thermoplastic sheet is not higher than 90 m/min.

3. The coating method as defined in claim 1, in which said thermoplastic sheet has a surface having a number of protrusion per unit length of not larger than 10 pieces per millimeter.

4. The coating method as defined in claim 1, in which said moving thermoplastic sheet is in any of the processing steps of a stretched sheet manufacturing process involving a sheet stretching step.

5. The coating method as defined in claim 1, in which said moving thermoplastic sheet is a non-stretched or monoaxially stretched sheet before stretching in transverse direction or in longitudinal and transverse directions simultaneously.

6. The coating method as defined in claim 1, in which said liquid coating agent is applied to the surface of said moving thermoplastic sheet except both edge portions of the sheet.

7. The coating method as defined in claim 1, in which air is blown from the outside against both edge portions where said thermoplastic sheet and said metering bar are in contact with each other.

8. The coating method as defined in claim 1, in which said thermoplastic sheet is a polyethyleneterephthalate sheet.

* * * * *